US005553998A

United States Patent [19]

Mühlhoff et al.

[11] Patent Number: 5,553,998

[45] Date of Patent: Sep. 10, 1996

[54] GAS FRICTION VACUUM PUMP HAVING AT LEAST THREE DIFFERENTLY CONFIGURED PUMP STAGES RELEASABLY CONNECTED TOGETHER

[75] Inventors: Martin Mühlhoff, Los Gatos, Calif.; Hans Kriechel, Bornheim, Germany; Frank Fleischmann, Bergheim-Glessen, Germany; Hans-Peter Kabelitz, Köln, Germany

[73] Assignee: Leybold AG, Hanau, Germany

[21] Appl. No.: 338,452

[22] PCT Filed: Apr. 23, 1993

[86] PCT No.: PCT/EP93/00984

§ 371 Date: Nov. 16, 1994

§ 102(e) Date: Nov. 16, 1994

[87] PCT Pub. No.: WO93/23672

PCT Pub. Date: Nov. 25, 1993

[30] Foreign Application Priority Data

May 16, 1992 [DE] Germany ..... 42 16 237.8

[51] Int. Cl.[6] ..... F01D 01/36

[52] U.S. Cl. ..... 415/90; 415/143

[58] Field of Search ..... 415/90, 143, 199.4, 415/199.5, 912

[56] References Cited

U.S. PATENT DOCUMENTS

| | | | |
|---|---|---|---|
| 3,947,193 | 3/1976 | Maurice | 415/143 |
| 4,732,529 | 3/1988 | Narita et al. | 415/90 |
| 4,826,393 | 5/1989 | Miki | 415/90 |
| 5,165,872 | 11/1992 | Fleischmann et al. | 415/90 |

FOREIGN PATENT DOCUMENTS

| | | | |
|---|---|---|---|
| 0159464 | 10/1985 | European Pat. Off. . | |
| 0363503 | 4/1990 | European Pat. Off. . | |
| 0408792 | 1/1991 | European Pat. Off. . | |
| 2525698 | 10/1983 | France . | |
| 2630167 | 10/1989 | France . | |
| 4216237 | 11/1993 | Germany | 415/143 |
| 0182394 | 9/1985 | Japan | 415/90 |
| 3085288 | 4/1988 | Japan | 415/143 |
| 0063698 | 3/1989 | Japan | 415/90 |

*Primary Examiner*—Edward K. Look
*Assistant Examiner*—Mark Sgantzos

[57] ABSTRACT

The invention relates to a gas friction vacuum pump having at least two differently configured pump stages each having a rotor section and a housing section. In order to adapt the pump to different applications, the pump stages are detachably connected with each other so that different inlet stages can be mounted on the high-vacuum side.

5 Claims, 2 Drawing Sheets

GAS FRICTION VACUUM PUMP HAVING AT LEAST THREE DIFFERENTLY CONFIGURED PUMP STAGES RELEASABLY CONNECTED TOGETHER

BACKGROUND OF THE INVENTION

The invention relates to a gas friction vacuum pump with at least two differently configured pump stages, each comprising a rotor section and a stator section.

Molecular and turbomolecular vacuum pumps are friction pumps. In molecular pumps, a moving rotor wall and a resting stator wall are configured and spaced apart in such a way that the pulses transferred from the walls to gas molecules disposed between the walls have a preferred direction. Normally, rotor and/or stator walls are provided with thread-like recesses or projections. Turbomolecular vacuum pumps are provided with intermeshed rows of stator and rotor blades, much like a turbine.

Turbomolecular pumps have a relatively low compression (pressure ratio between pressure on the pressure side and the suction side) and a relatively high suction capacity (pumping speed, volume flow per unit of time). Their manufacture and installation is complex and expensive. Moreover, they require a forevacuum pressure of approximately $10^{-2}$ mbar. Molecular pumps are provided with a relatively high compression but their suction capacity is relatively small.

They deliver pressures of up to 10 mbar and more so that the required complexity for the generation of the forevacuum is less than in turbomolecular pumps. It is therefore known to provide gas friction vacuum pumps with differently configured pump stages, with the pump stage on the forevacuum side usually being a molecular pump stage because of the better critical forepressure.

SUMMARY OF THE INVENTION

It is the object of the present invention to create a gas friction vacuum pump of the type mentioned in the beginning, which can be adapted to various applications in a simple manner.

According to the invention this object is solved by providing a gas friction pump that has a vacuum side and a pressure side, that together define a respective direction of flow of a gas through the pump. The pump includes at least three differently configured pump stages sequentially and releasably connected to each other, each comprising a housing section, and a rotor located within the respective housing section. One of the pump stages is a molecular pump stage located on the pressure side of the pump, with the rotor of the molecular pump stage having a frustoconical hub tapering away from the pressure side. Another of the pump stages is a filling stage preceding the molecular pump stage in a direction toward the vacuum side. The housing section of the filling stage constitutes a stator that surrounds the rotor of the filling stage. The rotor of the filling stage comprises a frustoconical, central hub that tapers away from the pressure side and adjoins the frustoconical hub of the molecular pump stage so that the two adjoining hubs form a continuous, frustoconical shape. The rotor of the filling stage further includes a plurality of radial, helical webs attached to the central hub. Each helical web has a pitch and a width that decreases in a direction toward the pressure side for the pumping of the gas. Another of the pump stages is a turbo molecular pump stage that precedes the filling pump stage and is on the vacuum side of the pump.

The measures which are proposed offer the advantage that the ultimate pressure behavior of the pump can be influenced in a graduated manner by means of simple variations of the rotor and stator components. By means of modularly attachable turbomolecular pump stages on a molecular pump stage alone it is possible to clearly influence the pumping properties of the entire pump. The basic configuration of the molecular pump switched downstream is not influenced.

BRIEF DESCRIPTION OF THE DRAWINGS

Further advantages and details of the invention will be explained by way of embodiments illustrated in the FIGS. 1 through 4. These show.

DESCRIPTION OF THE PREFERRED EMBODIMENTS

Figure 1:
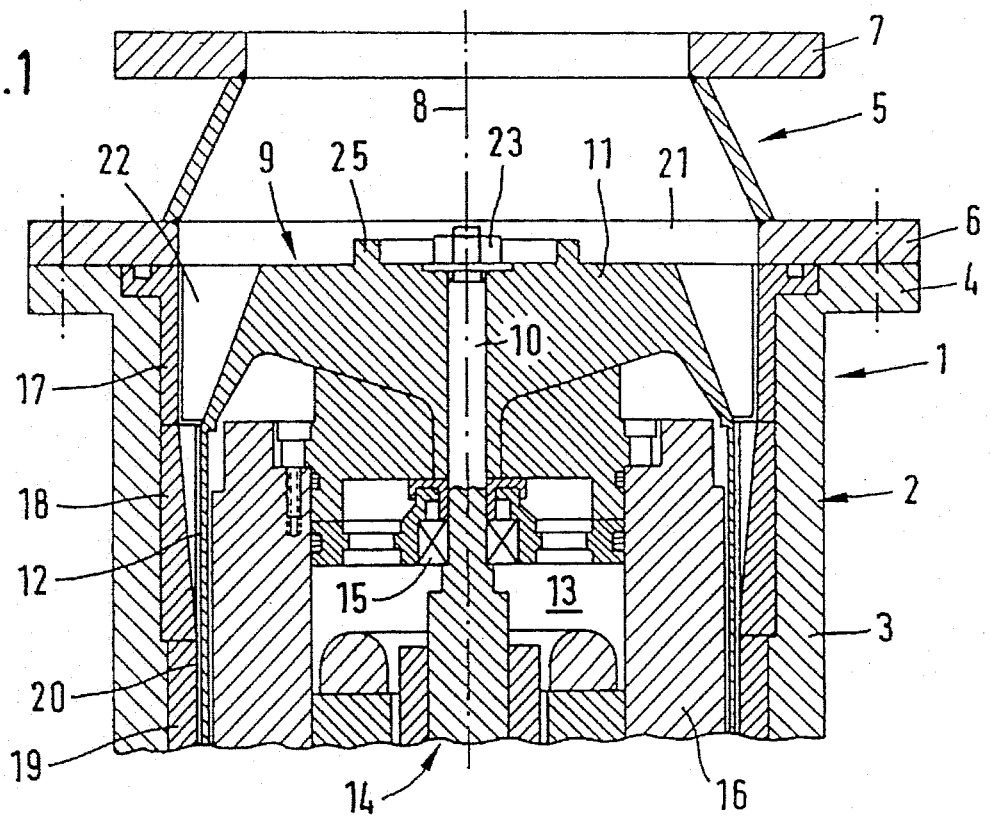
FIG. 1 a section through a friction pump according to the invention configured as a molecular pump, FIG. 2 a partial section through a friction pump according to FIG. 1 which is provided with a turbomolecular pump stage disposed on the high-vacuum side as well as FIGS. 3 and 4 further variations of different friction vacuum pump stages.

The friction pump 1 shown in FIG. 1 is provided with a first housing section 2. The outer cylinder 3 which is provided with the flange 4, is part of this first housing section 2. With the aid of the flange 4, the friction pump 1 can be connected, either directly or via a reducer 5, with the flanges 6 and 7 to the receiver which is to be evacuated. The reducer 5 is required in cases where the diameter of the flange 4 of the pump 1 is smaller or larger than the diameter of the flange of the receiver which is not shown.

The rotor 9 is provided with a bell-shaped configuration. It comprises the shaft 10 with its rotational axis 8, the hub 11 and the cylindrical section 12. The drive motor 14 and at least the upper bearing of the two rotor bearing arrangements 15 are disposed within the space 13 which is formed by the bell-shaped rotor 9. The motor 14 and the rotor bearing arrangements 15 are supported by the component 16 which is fixedly connected to the housing.

The outside of the bell-shaped rotor 9 together with the inside of the outer cylinder 3 make up the active pumping surfaces of a molecular pump stage 3, 12 that is the ring-shaped gas delivery channel 20. In a manner which is known per se (EU-A-408 792), separate rings 17, 18, 19 may be provided for the configuration of the inside of the outer cylinder 3. The gases that are to be pumped are delivered from the inlet 21 to the outlet which is not shown. A forevacuum pump, which is also not shown, is connected to the outlet during the operation.

In the region of hub 11 disposed on the high-vacuum side, the rotor 9 has a conical configuration such that its diameter increases in the direction of the flow. A smooth inner surface of the outer cylinder 3 and of the associated ring 17 is associated with this region. Structures 22 which serve the purpose of gas delivery are provided on the rotor 9 itself. They may, for example, be configured as radial webs whose width decreases in the direction of the flow so that the molecular pump stage 3, 12 has an inlet stage 17, 22 with improved volumetric capacity.

In the region of the end of the shaft 10 on the high-vacuum side, the rotor 9 is fastened by means of a screw 23.

The face of rotor 9 is provided with a circular projection 25 disposed concentrically with respect to the rotational axis 8. This projection 25 is a part of centering means which are provided on both the rotor 9 and the further rotor sections to be described in the subsequent paragraph which are to be fastened to the face of rotor 9.

Figure 2:
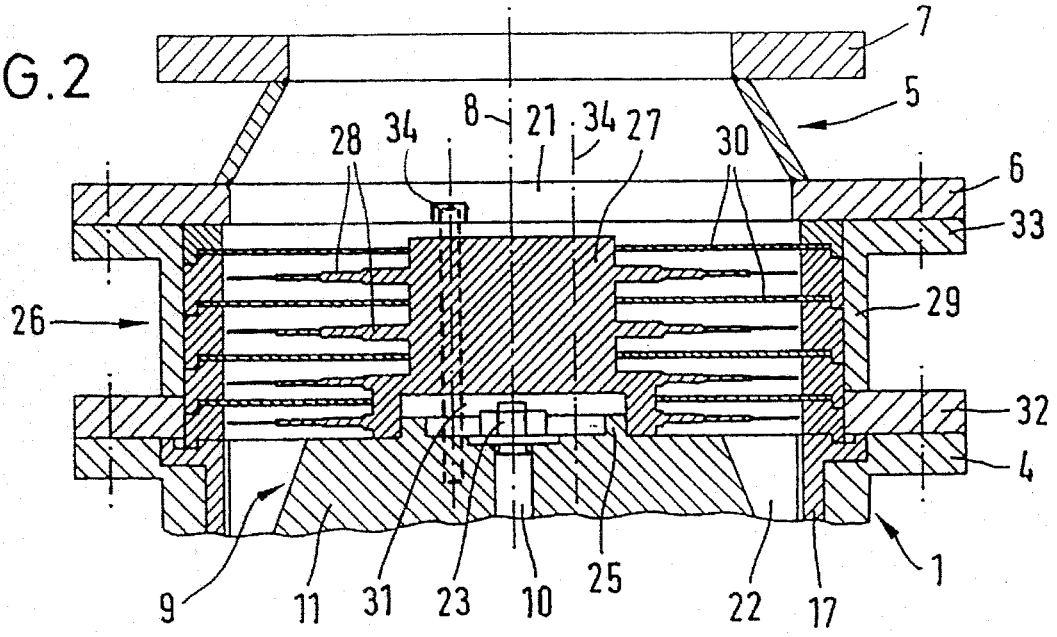

In the embodiment according to FIG. 2, the molecular pump stage 3, 12 is preceded by a turbomolecular pump stage 26. The latter consists of the rotor section 27 with its rotor blades 28 and the housing section 29 with its stator blades 30. The face of the rotor section 27 facing the rotor 9 is provided with a recess 31 (centering means) which is concentric with respect to the rotational axis 8. The diameter of this recess corresponds to the outside diameter of the circular projection 25 on the face of the rotor 9 so that the desired centering with respect to the rotational axis 8 is achieved. The housing section 29 is provided with the flanges 32 and 33. The turbomolecular pump stage 26 is fastened to the flange 4 of the molecular pump stage 3, 12 by means of the flange 32 disposed on the forevacuum side. Either the recipient which is to be evacuated is mounted directly to flange 33 or the reducer 5.

Advisably, screws 34 are employed for the fastening of the rotor section 27 to the rotor 9 of the molecular pump stage, with the screws axially extending through the rotor section 27 and being screwed into the face of the rotor 9. The position of the screws is indicated by dash-dot lines 34.

Figure 3:
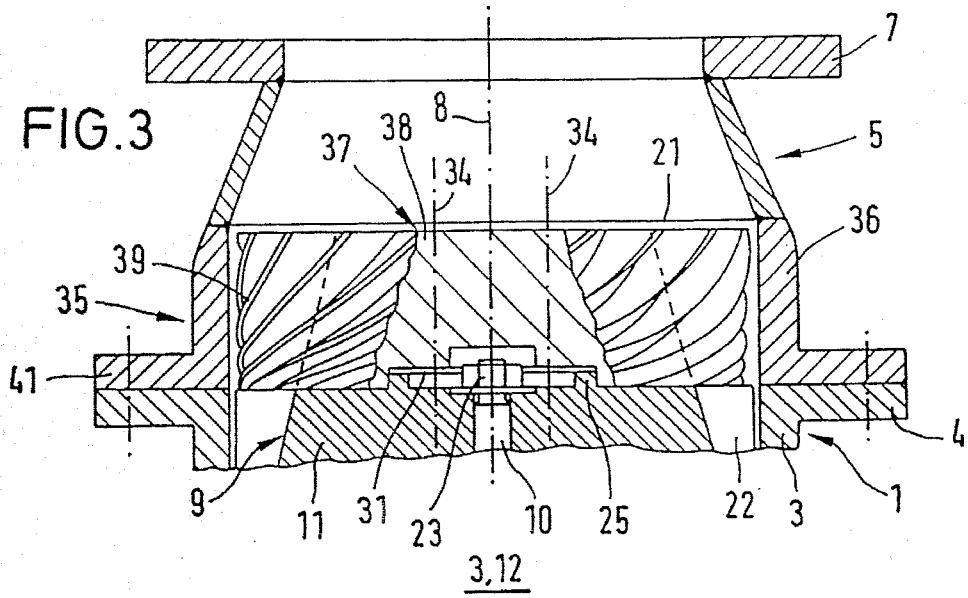

In the embodiment according to FIG. 3, the molecular pump stage 3, 12 is preceded by a special friction pump stage (filling stage 35) whose housing section 36 is provided with a smooth inner surface and forms a stator. The rotor section 37 is configured in a manner that is described in EU-A 363 503. The rotor section 37 comprises a central part 38 and webs 39. The webs form the structures which effect the gas delivery. Their width and their ascending gradient decrease from the suction side towards the pressure side. This requires a conical configuration of the central part 38. It is particularly advisable for the conicity of the hub 11 of the rotor 9 of the molecular pump stage 3, 12, to continuously follow the conicity of the central part 38 of the rotor section 37, as shown by the hidden lines in FIGS. 3 and 4. In these figures, the sectional view of the filling stage is taken at a location offset, but parallel to, axis 8, so that the base surface of central part 34 is only illustrated by the hidden lines.

On the forevacuum side, the housing section 36 is provided with the flange 41 which is connected to the flange 4 of the molecular pump stage 3, 12. On the inlet side, it is welded to the reducer 5 so as to form a single component.

It is, of course, also possible to connect housing section 36 and reducer 5 via flanges. A reducer 5 according to FIG. 2 must then be used together with a filling stage 35 according to FIG. 4.

Figure 4:
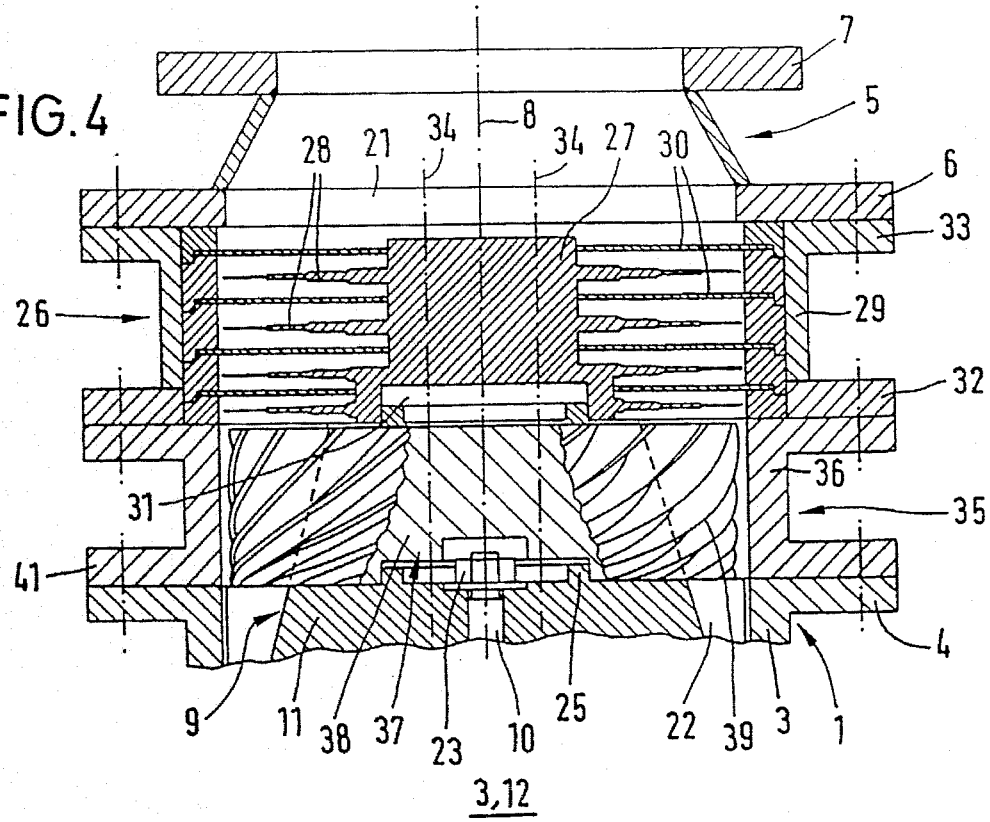

In the embodiment according to FIG. 4, the molecular pump stage 3, 12 is preceded in the direction of the flow by a turbomolecular pump stage 26 and a filling stage 35. The associated housing sections 3, 36, 29 are connected via flanges. The connection of the rotor sections 9, 37, 27 is implemented in the manner described with regard to FIG. 2. The respective centering means are advisably provided with identical diameters so that the desired modular configuration is possible. If the molecular pump stage 3, 12 is preceded by two further pump stages on the high-vacuum side, it is merely necessary to use longer fastening screws 34 for the fastening of the two rotor sections.

I claim:

1. A gas friction pump having a vacuum side and a pressure side together defining a respective direction of flow of a gas through the pump, and comprising:

at least three differently configured pump stages sequentially and releasably connected to each other, each comprising a housing section, and a rotor located within the respective housing section;

a first of said pump stages being a molecular pump stage located on the pressure side of said pump, the rotor of said molecular pump stage having a frustoconical hub tapering away from the pressure side;

a second of said pump stages being a filling stage preceding said molecular pump stage in a direction toward the vacuum side, the housing section of said filling stage constituting a stator surrounding the rotor of said filling stage, said rotor of said filling stage comprising a frustoconical, central hub tapering away from the pressure side and adjoining the frustoconical hub of said molecular pump stage so that the two adjoining hubs form a continuous, frustoconical shape, said rotor of said filling stage further including a plurality of radial, helical webs attached to the central hub, each helical web having a pitch and a width decreasing in a direction toward the pressure side for the pumping of the gas; and a third of said pump stages being a turbomolecular pump stage preceding said filling pump stage and being on the vacuum side of said pump.

2. The pump defined in claim 1, wherein said rotor of said molecular pump stage includes an essentially cylindrical section attached to a base of the respective frustoconical hub, and said housing section of said molecular pump stage has an essentially cylindrical shape surrounding the cylindrical section of the respective rotor to form a gas supply channel with a ring-shaped cross section therebetween.

3. The pump defined in claim 2, wherein the frustoconical hub of said molecular pump stage includes a plurality of radial webs attached thereto for the pumping of the gas.

4. The pump defined in claim 1, wherein each rotor has a face opposing an adjacent rotor face, and means for centering the respective rotor relative to the other rotors located on the respective face.

5. The pump defined in claim 1, wherein the housing section of said turbomolecular pump stage includes an integrally connected reducer on the vacuum side of the pump.

* * * * *